United States Patent [19]

George

[11] Patent Number: 4,774,992

[45] Date of Patent: Oct. 4, 1988

[54] APPARATUS AND METHOD FOR USE IN CASTING A PLURALITY OF ARTICLES

[75] Inventor: Thomas George, Euclid, Ohio

[73] Assignee: PCC Airfoils, Inc., Cleveland, Ohio

[21] Appl. No.: 62,513

[22] Filed: Jun. 15, 1987

[51] Int. Cl.[4] ..... B22D 25/00; B22D 27/04

[52] U.S. Cl. ..... 164/122.1; 164/338.1; 164/127

[58] Field of Search ..... 164/122, 122.1, 122.2, 164/127, 338.1, 361

[56] References Cited

U.S. PATENT DOCUMENTS

| | | | |
|---|---|---|---|
| 3,690,368 | 9/1972 | Copley et al. . | |
| 3,714,977 | 2/1973 | Terkelsen . | |
| 3,810,504 | 5/1974 | Piwonka . | |
| 4,108,236 | 8/1978 | Salkeld | 164/122.1 X |

OTHER PUBLICATIONS

PCT International Appln. No. PCT/US86/00166, filed 1/28/86, entitled "Method and Apparatus for Casting Articles"-this application corresponds to U.S. Pat. No. 4,673,021 (copy of application drawings enclosed).

U.S. Pat. Appln. Ser. No. 13,469, filed 2/11/87, entitled "Method and Apparatus for use in Casting Articles" (copy of application drawings enclosed).

*Primary Examiner*—Kuang Y. Lin

*Attorney, Agent, or Firm*—Tarolli, Sundheim & Covell

[57] ABSTRACT

A chill plate moves the mold structure into a furnace, A baffle is supported in an open central portion of an array of article molds by a plurality of support elements. The support elements extend through spaces between the article molds into engagement with a furnace to support the baffle during withdrawal of the article molds from the furnace. In one embodiment of the invention, the support elements are engaged with the furnace by rotating the chill plate through a small arc. When the article molds have been almost completely withdrawn from the furnace, the baffle plate is disposed adjacent to the upper ends of the article molds. At this time, the chill plate is again rotated to disengage the support elements from the furnace. When this happens, the baffle drops downwardly onto the chill plate. Disengagement of the support elements from the furnace may be facilitated by forming the support elements of a relatively brittle material which will break when pressure is applied against either the baffle or the support elements by the mold structure.

112 Claims, 6 Drawing Sheets

APPARATUS AND METHOD FOR USE IN CASTING A PLURALITY OF ARTICLES

BACKGROUND OF THE INVENTION

The present invention relates to a new and improved apparatus and method for use in casting a plurality of articles in a mold structure.

A mold structure having a plurality of article molds disposed in an array with an open central portion and a gating system extending across an upper end of the open central portion of the array of article molds is disclosed in U.S. Pat. No. 3,690,368 issued Sept. 12, 1972 and entitled Casting Single Crystal Articles. This patent teaches that thermal gradients within a mold structure and the rate of solidification of molten metal can be controlled by surrounding the article molds with metal which is being cast. The forming of the cavities which surround the article molds complicates the making of the mold structure. In addition, the filling of the cavities surrounding the article molds with molten metal increases the quantity of molten metal required to cast articles.

The use of a baffle plate to retard the transfer of heat from article molds is disclosed in U.S. Pat. No. 3,714,977 issued Feb. 6, 1973 and entitled Method and Apparatus for the Production of Directionally Solidified Castings. The baffle plate is in the form of an annular disk which has an inner edge which surrounds and closely fits the mold structure at a location adjacent to a chill plate upon which the mold structure is supported. When the chill plate and mold structure are lowered from a furnace, the baffle plate is supported by flanges connected with the furnace and remains stationary during continued lowering of the chill plate and mold structure. The baffle plate is not disposed between article molds and is ineffective to retard heat transfer on paths which are disposed between the article molds.

A method and apparatus for use in casting a plurality of articles in a mold structure having a plurality of article molds disposed in an array with an open central portion is disclosed in U.S. Pat. No. 3,810,504 issued May 14, 1974 and entitled Method for Directional Solidification. The apparatus disclosed in this patent includes an annular chill plate upon which the mold structure is supported. A baffle plate is disposed in a central portion of the array of article molds and is supported by an inner heat sink or chill. During withdrawal of the mold from the furnace, the mold moves downwardly between inner and outer heat sinks. The combination of the annular chill plate and inner and outer heat sinks results in a relatively complicated apparatus which is difficult to operate and maintain.

A mold structure having a plurality of article molds disposed in an array with an open central portion is disclosed in Patent Cooperation Treaty International Application No. PCT/US/8600166 filed Jan. 28, 1986 and entitled Method and Apparatus for Casting Articles and in corresponding U.S. Pat. No. 4,673,021. This application and corresponding U.S. Patent disclose the concept of obtaining a large temperature gradient with a baffle which blocks the radiation of heat from the open central portion of the array of article molds as they are withdrawn from a furnace.

The mold structure disclosed in the aforementioned Patent Cooperation Treaty Application and U.S. Patent includes a gating or molten metal distribution system which is separate from the article molds. The baffle is supported by a downwardly extending support post which is connected with the gating system. The gating system is connected with the furnace. The construction of the gating system is complicated by the necessity of forming the baffle with its support post extending from the gating system. In addition, when the mold structure is used, the gating system must be connected with the furnace.

SUMMARY OF THE PRESENT INVENTION

The present invention provides a new and improved method and apparatus for use in casting a plurality of articles in a mold structure having an open central portion. A baffle is disposed in the open central portion of the array of article molds to retard the transfer of heat from the article molds to a chill plate upon which the article molds are supported. As the article molds are withdrawn from a furnace, the baffle is supported by a plurality of support elements which are connected with the furnace and extend through spaces between the article molds. After the mold structure has been partially withdrawn from the furnace, the surface elements are disconnected from the furnace and the baffle drops downwardly onto the chill plate to enable the mold structure to be completely withdrawn from the furnace.

In one embodiment of the invention, the support elements are connected with the furnace by moving the chill plate, article molds and the baffle together relative to the furnace to move the support elements into alignment with retainer surfaces connected with the furnace. When the mold structure has been partially withdrawn from the furnace, the support elements are separated from the retainer surfaces by reversing the movement of the chill plate and mold structure.

In another embodiment of the invention, the support elements are moved into engagement with retainers connected with the furnace to support the baffle from the furnace. After the mold structure has been partially withdrawn from the furnace, the baffle is released by disconnecting the support elements from the retainers. This may be accomplished by applying force against the baffle or support elements with surfaces of the mold structure. In still another embodiment of the invention, the support elements are broken to release the baffle.

Accordingly, it is an object of this invention to provide a new and improved apparatus and method for use in casting a plurality of articles and wherein a baffle is supported in the open central portion of an array of article molds by a plurality of support elements which are connected with the furnace.

Another object of this invention is to provide a new and improved apparatus and method as set forth in the preceding object wherein the baffle is disconnected from the furnace after the article molds have been at least partially withdrawn from the furnace.

Another object of this invention is to provide a new and improved apparatus and method as set forth in either of the preceding objects and wherein the support elements extend through spaces between the the article molds.

BRIEF DESCRIPTION OF THE DRAWINGS

The foregoing and other objects and features of the present invention will become more apparent upon consideration of the following description taken in connection with the accompanying drawings wherein.

DESCRIPTION OF SPECIFIC PREFERRED EMBODIMENTS OF THE INVENTION

General Description

Figure 1:
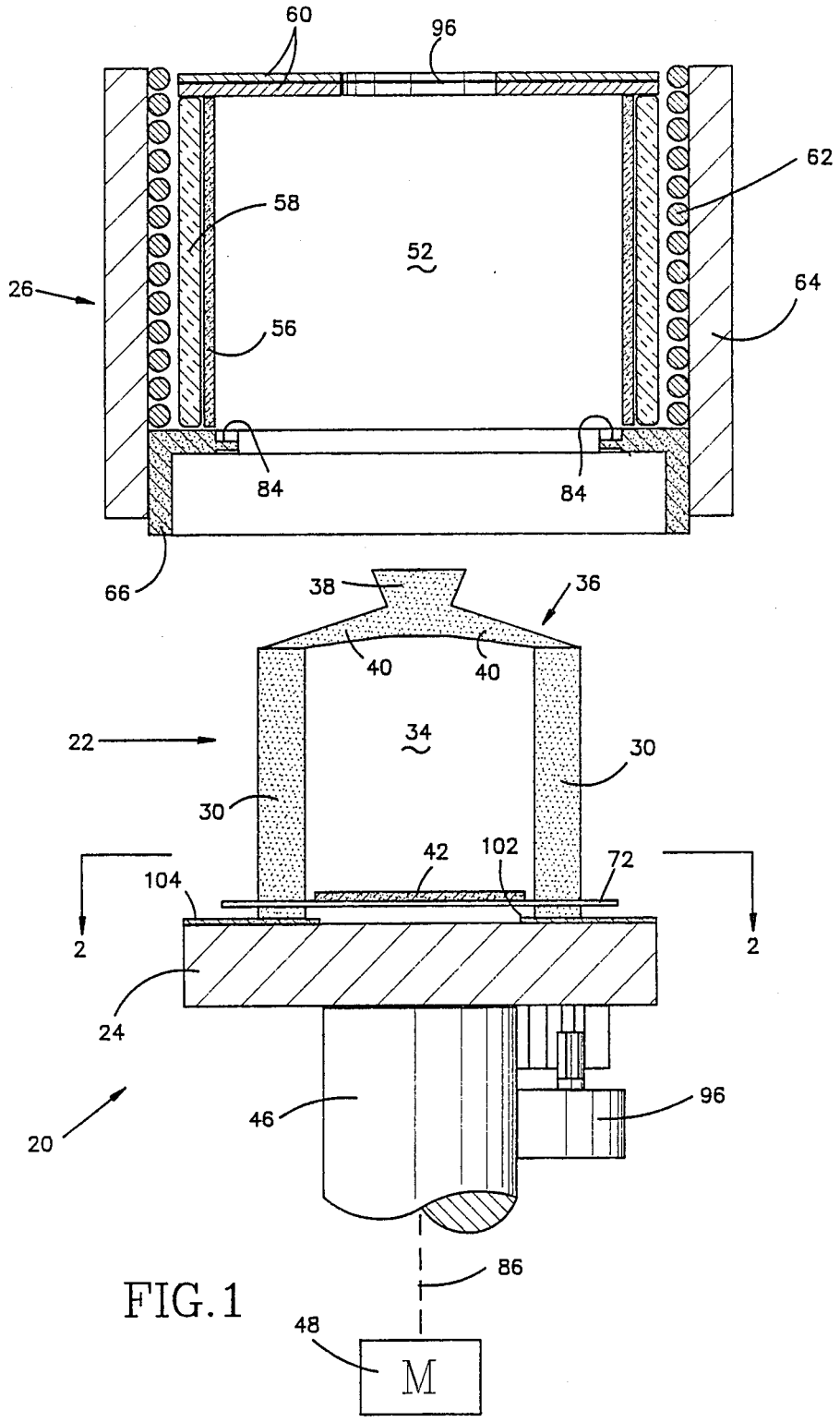
FIG. 1 is a schematic illustration of an apparatus for use in casting a plurality of articles and wherein a mold structure is supported beneath a furnace on a chill plate.

An apparatus 20 for use in casting a plurality of articles, such as blades or vanes for a turbine engine, is illustrated in FIG. 1 and includes a mold structure 22 which is supported on a chill plate 24 below a furnace 26. The one-piece ceramic mold structure 22 includes a plurality of article molds 30 disposed in an annular array about an open central portion 34. It should be understood that although only two article molds 30 are illustrated in FIG. 1, additional article molds are arranged in a circular array in a manner similar to that disclosed in Patent Cooperation Treaty Application No. PCT/US/8600166 filed Jan. 28, 1986 for Method and Apparatus for Casting Articles.

The one-piece ceramic mold structure 22 includes a gating system 36 which extends across an upper end of the open central portion 34 of the array of article molds 30. The gating system 36 includes a pour cup 38 which is connected with each of the article molds 30 by a plurality of runners 40. The runners 40 extend radially outwardly from the pour cup in a manner similar to that disclosed in U.S. Pat. No. 3,680,625 issued Aug. 1, 1972 for Heat Reflector and U.S. Pat. No. 4,550,764 issued Nov. 5, 1985 for Apparatus and Method for Casting Single Crystal Articles.

Figure 2:
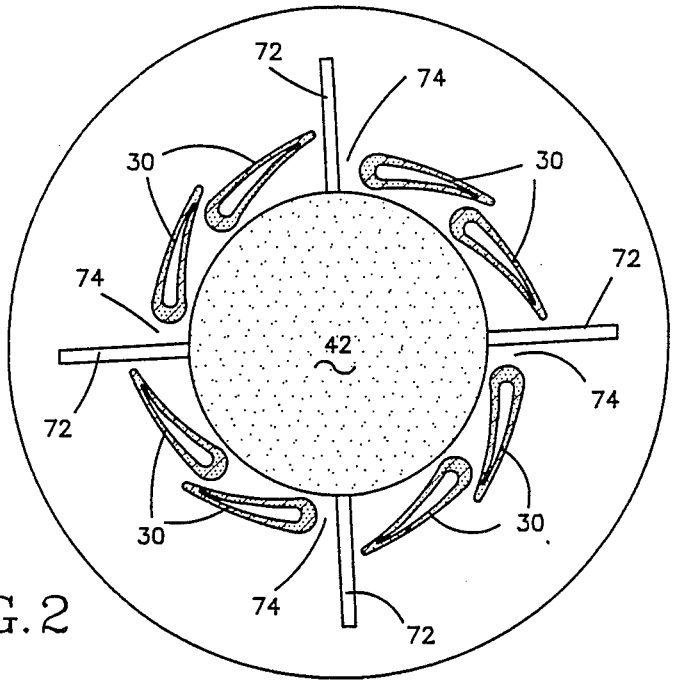
FIG. 2 is a sectional view, taken generally along the line 2—2 of FIG. 1, illustrating the relationship of a baffle to article molds disposed in an annular array about an open central portion of the mold structure.

A circular baffle 42 (FIGS. 1 and 2) is disposed in the open central portion 34 of the array of article molds 30. The baffle 42 retards the transfer of heat from the article molds 30 through the open central portion 34 of the array of article molds to the chill plate 24. The baffle 42 can be made of any desired material. It is contemplated that the baffle may be a circular plate of heat insulating material, such as a graphite foil which is commercial available under the trademark "GRAPHFOIL".

The mold structure 22 is supported on the circular chill plate 24. The chill plate 24 may be formed of copper and water cooled in a known manner. The chill plate 24 is rotatably supported on a cylindrical support post 46 which is movable vertically toward and away from the furnace 26 by a motor 48. The chill plate 24, support post 46, mold structure 22 and baffle 42 are disposed in a coaxial relationship.

The furnace 26 supplies heat to the mold structure 22 when the mold structure is disposed in a cylindrical chamber 52 in the furnace. The induction furnace 26 includes a cylindrical susceptor wall 56 formed of graphite and surrounded by a cylindrical graphite insulating layer 58. Circular graphite cover panels 60 are supported by the susceptor wall 56. Circular turns of an induction coil 62 extend around the susceptor wall 56 and are enclosed by a cylindrical outer wall 64 of the furnace. A ceramic base or Cambridge ring 66 of ceramic material is connected with the outer wall 64 or other structure of the furnace and defines a circular opening 68 to the furnace chamber 52.

In accordance with one of the features of the present invention, a plurality of support elements or rods 72 extend outwardly from the baffle plate 42 (FIG. 2) through spaces 74 between article molds 30 in the annular array of article molds. The support elements 72 extend radially outwardly from the annular array of article molds 30 to enable the support elements to be connected with the furnace 26. The support elements 72 are connected with the furnace 26 to support the baffle 42 in a stationary relationship with the furnace during withdrawal of the article molds 30 from the furnace.

Figure 3:
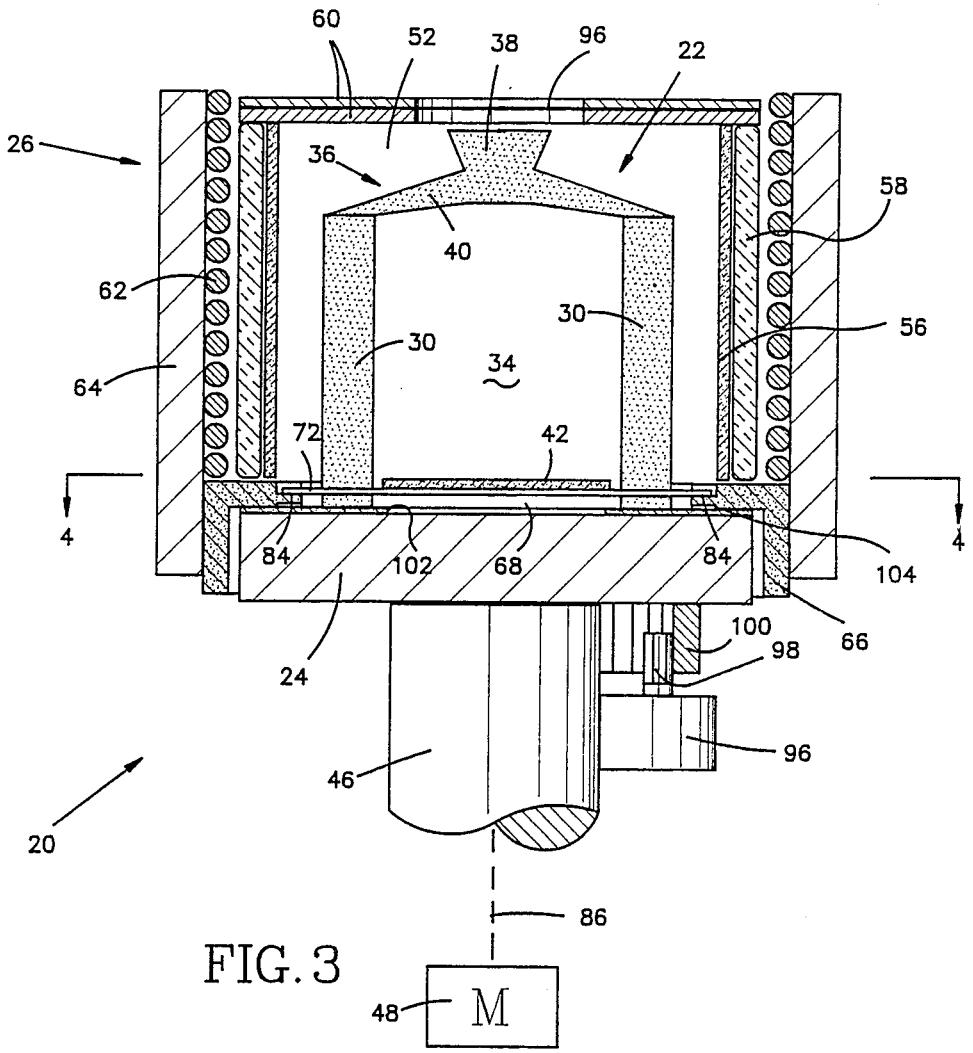
FIG. 3 is a schematic illustration, generally similar to FIG. 2, illustrating and the mold structure of FIG. 1 in the furnace.

To connect the baffle 42 with the furnace 26, the chill plate 24 is raised with the rods 72 vertically aligned with openings 80 (FIG. 4) formed in annular base or Cambridge ring 66. After the support elements 72 have moved through the openings 80 to a level above retainer surfaces 84, the chill plate 24, mold structure 22 and baffle 42 are rotated about the vertical central axis 86 (FIG. 3) of the chill plate 24 in a clockwise direction, as indicated by the arrow 88 in FIG. 4. This moves the support rods 72 horizontally from the position shown in solid lines in FIG. 4 to the position shown in dashed lines in which the outer end portions of the support rods are disposed in engagement with the retainer surfaces 84

Figure 5:
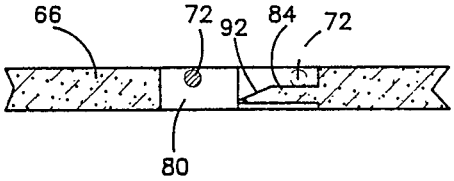
FIG. 5 is a fragmentary sectional view, taken generally along the line 5—5 of FIG. 4, illustrating the manner in which a baffle support element moves into alignment with a support surface connected with the furnace during rotation of the mold structure and baffle.

(FIG. 5). Since the entire mold structure 22 is rotated with the baffle 42, the article molds 30 are effective to apply force against the support rods 72 to force them up inclined ramp surfaces 92 (FIG. 5) onto the horizontal retainer surfaces 84.

After the mold structure 22 has been preheated in the furnace chamber 52 (FIG. 3), molten metal is poured in an known manner through a circular central opening 96 in the circular cover panels 60. This molten metal is conducted from the pour cup 38 through the runners 40 to the article molds 30. Once the article molds 30 have been filled with molten metal, the chill plate 24 is slowly lowered to withdraw the article molds 30 from the furnace 26. As the article molds 30 are withdrawn from the furnace chamber 52, the horizontal baffle 42 remains stationary and is effective to block the transfer of heat to the chill plate 24 from the portion of the article molds disposed above the baffle.

Once the article molds 30 have been withdrawn from the furnace 25 (FIG. 6), the support elements 72 are disconnected from the furnace. To accomplish this, the chill plate 24 is rotated to move the support elements 72 along a horizontal path and out of engagement with the retainer surfaces 84. Thus, the chill plate 24, mold structure 22 and baffle plate 42 are rotated in a counterclockwise direction (as viewed in FIG. 4) to move the support elements from the position shown in dashed lines in FIG. 4 to the position shown in solid lines. As the support elements 72 are moved off of the retainer surfaces 84 and into the openings 80, the baffle 42 is released. The baffle 42 then drops downwardly from the position shown in FIG. 6 adjacent to the upper end portions of the article molds 30 to the position shown in FIG. 7 in which the baffle 42 is adjacent to the lower end portions of the article molds.

Once the baffle 42 has been disconnected from the furnace 26, the withdrawal of the mold structure 22 is completed by continuing to operate the motor 42 to lower the chill plate 24. As this occurs, the baffle 42 and mold structure 22 move vertically downwardly with the chill plate 24.

In order to rotate the chill plate 24, mold structure 22 and baffle 42 about the central axis 86 of the chill plate, a reversible motor 96 (FIG. 6) is operated to drive a pinion gear 98 which meshes with an arcuate rack gear segment 100. The chill plate 24 is connected with the support post 46 by a pivot connection (not shown) which allows the chill plate to rotate through a relatively small arcuate distance. This arcuate distance is sufficient to enable the support elements 72 to move along a horizontal path between the positions shown in solid and dashed lines in FIG. 4. Although it is preferred to rotate the chill plate 24 relative to the support post 46, the chill plate 24 and support post 46 could be rotated together about their vertical central axis 86 if desired. If this was done, the motor 96 would be mounted on a base and the pinion 98 would be disposed in meshing engagement with a gear segment connected to the support post 46.

The one-piece ceramic mold structure 22 is formed by repetitively dipping a wax pattern in a slurry of ceramic mold material. The wax pattern is formed of one piece and has a configuration corresponding to the configuration of the mold structure. After the wax pattern has been repetitively dipped, it is covered with a layer of ceramic mold material which is dried, dewaxed and then fired.

To enable the support element 72 to withstand the high temperatures to which they are exposed, the support elements are rods formed of stainless steel or other materials such as a ceramic. The support elements 72 extend diametrically across the open central portion 34 of the mold structure 22 and project radially outwardly of the annular array of article molds 30. Although only two support elements 72 are used, it is contemplated that additional support elements could be used if desired. Although the support elements 72 are disposed beneath the baffle 42, the support elements could extend through the baffle if desired. Of course, support elements other than the rods 72 could be used if desired.

Operation

When a plurality of articles are to be cast, the mold structure 22 is formed by repetitively dipping a wax pattern in a ceramic mold material in a manner similar to that described in U.S. Pat. No. 4,066,116 issued Jan. 3, 1978 and entitled Mold Assembly and Method of Making the Same. The ceramic mold material is dried over the wax pattern and the wax pattern is then removed. The resulting mold structure is then fired to have the requisite strength.

The baffle 42 is inserted through a circular opening 102 formed in an annular base ring 104 which interconnects lower end portions of the article molds 30. The support elements 72 (FIGS. 2 and 4) are then inserted beneath the baffle 42 through the spaces 74 between the article molds 30. The support elements 72 extend diametrically across the annular array of article molds 30 and project radially outwardly from the annular array of article molds.

The mold structure 22 is then placed on the chill plate 24. At this time the baffle 42 rests on the horizontal support rods 72 which in turn rest on and a project radially outwardly from the annular base ring 104 (See FIG. 1). The support elements 72 are positioned in vertical alignment with the openings 80 (FIG. 4) formed in the base or Cambridge ring of the furnace 26.

The reversible motor 48 is then operated to raise the chill plate 24 and move the mold structure 22 into the furnace chamber 52. As the mold structure 22 enters the furnace chamber 52, the support rods 72 move into the openings 80 in the Cambridge ring 66 to the position indicated in solid lines in FIG. 5.

The motor 96 is then operated to rotate the chill plate 24. As the chill plate 24 is rotated, the article molds 30 apply force against the support elements 72. The force applied against the support elements 72 by the article molds 30 moves the support elements into vertical alignment with the retainer surfaces 84 on the Cambridge ring 66.

The furnace coil 62 is then energized to preheat the mold. After the mold has been preheated, molten metal is poured through the opening 96 in the upper panels 60 of the furnace 26 into the pour cup 38. The molten metal flows from the pour cup 38 through the runners 40 into the article molds 30. In one specific instance, the article molds 30 were used to cast turbine engine components and the molten metal was a nickel chrome super alloy.

After the article molds 30 have been filled with molten metal, the motor 48 is operated to slowly move the chill plate 24 vertically downward. As the chill plate is lowered, the baffle 42 rests on the horizontal support elements 72 in a stationary relationship with the furnace 26. Therefore, as the mold structure is withdrawn from the furnace, the lower end portions of the article molds 30 move downwardly past the stationary baffle 42 and are exposed to the central portion of the chill plate 24. The horizontal baffle 42 retards the transfer of heat from the upper portions of the article molds 30 to the chill plate 24 and to the environment outside of the furnace 14.

Figure 6:
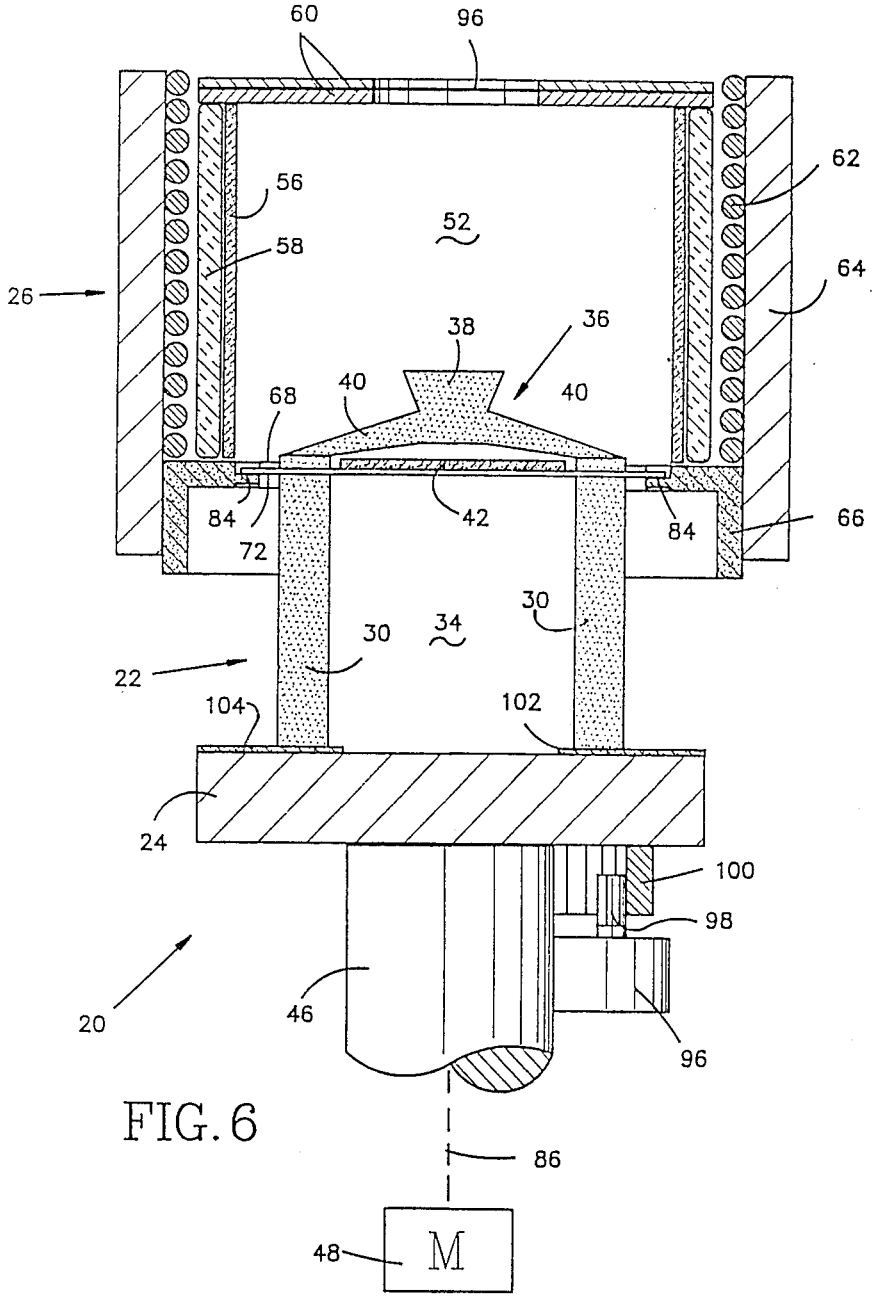
FIG. 6 is a schematic illustration, generally similar to FIGS. 1 and 3, illustrating and the mold structure partially withdrawn from the furnace with the baffle supported by the furnace adjacent to upper end portions of article molds.

As the article molds 30 are gradually withdrawn from the furnace 26, a relatively large temperature gradient is established between the upper and lower end portions of the article molds. Therefore, the metal in the article molds 30 solidifies upwardly from the chill plate 24 as the chill plate and mold structure 22 are lowered. However, the metal in the upper end portions of the article molds remains molten until the mold structure 30 is almost completely withdrawn from the furnace 26 and the baffle 42 is adjacent to the upper end portions of the article molds (FIG. 6).

When the chill plate 24 and mold structure 22 have been lowered through a distance sufficient to move the gating system 36 into engagement with the stationary support elements 72 (FIG. 6), the molten metal in the article molds 30 will have solidified. Therefore, it is no longer necessary to use the baffle 42 to retard the transfer of heat from the article molds to the chill plate 24. At this time, the baffle 42 is disconnected from the furnace 26.

Figure 4:
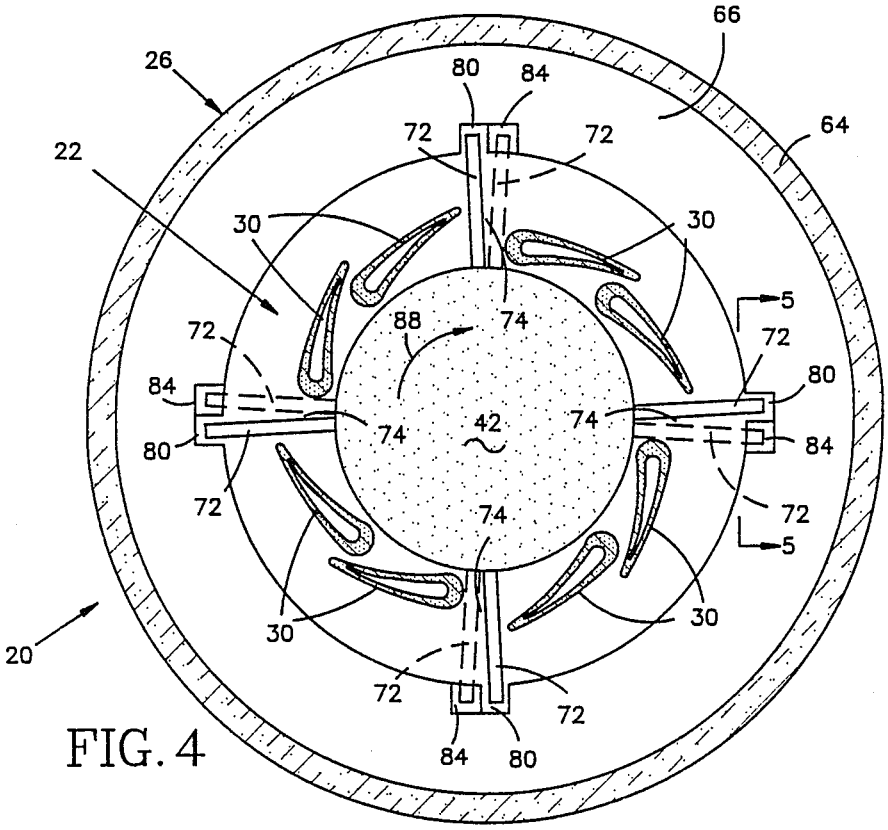
FIG. 4 is a schematic plan view, taken generally along the line 4—4 of FIG. 3, illustrating the manner in which a chill plate, mold structure and baffle are rotated relative to the furnace to align baffle support elements with support surfaces connected with the furnace.
Figure 7:
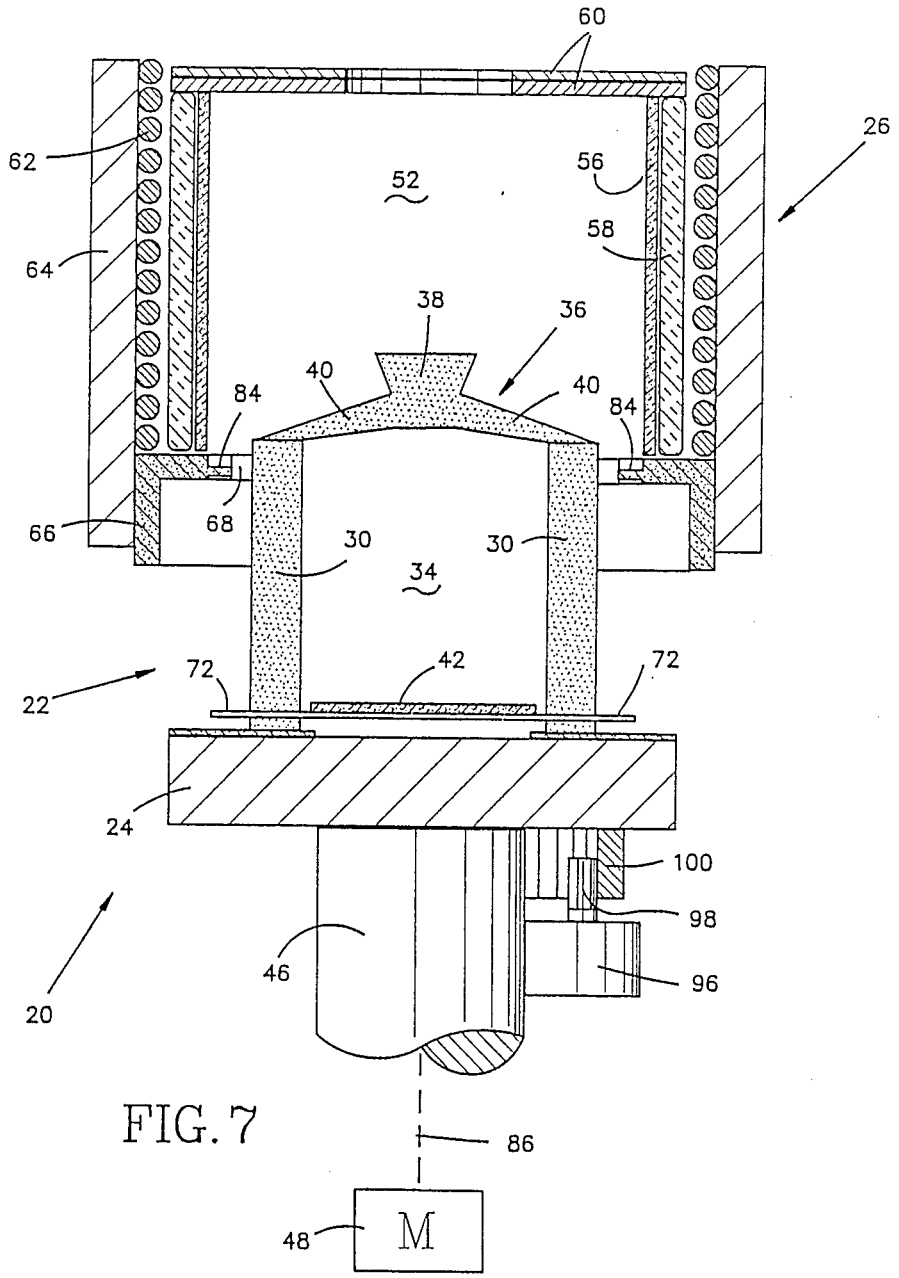
FIG. 7 is a schematic illustration, generally similar to FIG. 6, illustrating the relationship between the mold structure and baffle after the baffle has been released from the furnace and dropped downwardly to a position adjacent to lower end portions of the article molds.

To disconnect the baffle 42 from the furnace 26, the motor 96 is again energized to rotate the chill plate 24 in a counterclockwise direction (as viewed in FIG. 4). This rotates the mold structure 22 relative to the furnace 26. As the mold structure 22 is rotated about the central axis 86 of the chill plate 24, the article molds 30 apply force against the support elements 72 to move them off of the retainer surfaces 84 and into the openings 80. This releases the support elements 72 and baffle 42 for downward movement. The support elements 72 and baffle 42 then drop downwardly onto the chill plate 24 (FIG. 7).

The motor 48 continues to operate to lower the chill plate 24, mold structure 22 and baffle 42 together as the mold structure is completely withdrawn from the furnace 26. Thus, once the baffle 42 has dropped down onto the chill plate 24, there is no relative movement between the chill plate, baffle 42, support elements 72 and mold structure 22 as the chill plate continues to be lowered. The mold structure 22, with the cast articles therein, is subsequently removed from the chill plate 24. The cast articles are removed from the mold structure 22 by destroying the mold structure.

Although it is preferred to operate the motor 48 at a constant speed to continuously withdraw the mold structure 22 from the furnace 26 at a constant rate, the speed of operation of the motor could be varied if desired. Thus, the motor 48 could be operated at a relatively low speed to move the mold structure 22 to the position shown in FIG. 6. Since the molten metal has solidified in the article molds 30, the motor 48 can be operated at a relatively high speed to complete the withdrawal of the mold structure 22 from the furnace 26.

Second Embodiment of the Invention

In the embodiment of the invention illustrated in FIGS. 1–7, the chill plate 24, mold structure 22 and baffle 42 are rotated together to disconnect the baffle from the furnace 26. In the embodiment of the invention illustrated in FIG. 8, the support elements are merely broken to disconnect the baffle from the furnace. Since the embodiment of the invention illustrated in FIG. 8 is generally similar to the embodiment of the invention illustrated in FIGS. 1–7, similar components will be designated by similar numerals, the suffix letter "a" being associated with the numerals of FIG. 8 to avoid confusion.

Figure 8:
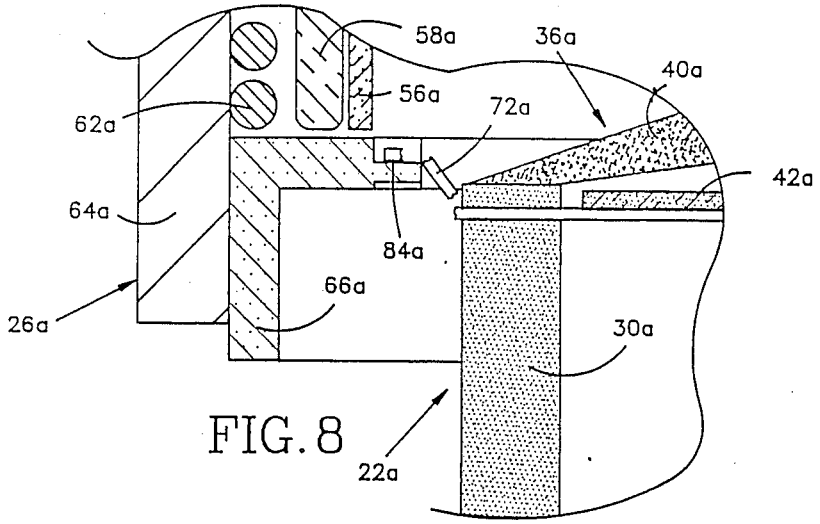
FIG. 8 is a schematic illustration of an embodiment of the invention in which baffle support elements are broken to release a baffle for downward movement after a mold structure has been partially withdrawn from the furnace.

In the embodiment of the invention illustrated in FIG. 8, the support elements **72*a* are formed of a relatively brittle ceramic material which, although being strong at high temperatures, cannot readily withstand bending moments. The support elements 72*a* extend radially outwardly from the baffle plate 42 through spaces between article molds 30*a***.

During the initial portion of the withdrawal of the mold structure **22*a* from the furnace 26*a*, the support elements 72*a* rest on the retainer surface 84*a* in a stationary relationship with the furnace 26*a*. After the article molds 30*a* have been withdrawn from the furnace chamber 52*a*, the ceramic mold material forming a connection between the runners 40*a* of the gating system 36*a* and the article molds 30*a* will engage the support elements 72*a* and apply a downward force directly against the support elements. As the mold structure 22*a* continues to be withdrawn from the furnace chamber 52*a*, the weight of the mold structure 22*a* on the support elements 72*a* will increase to an amount sufficient to break the support elements in the manner illustrated schematically in FIG. 8. Although only a single support element 72*a* has been shown in FIG. 8, it should be understood that there are a plurality of support elements 72*a* between the baffle 42*a* and the furnace 26*a* and that each of these support elements will be broken at the same time as the mold structure 22*a* is withdrawn from the furnace chamber 52*a***.

Once the support element **72*a* has been broken, the baffle 42*a* is released from the furnace 26*a*. The baffle 42*a* then drops downwardly onto the chill plate (not shown in FIG. 8). The baffle 42*a* will then move downwardly with the chill plate and mold structure 22*a* as the withdrawal of the mold structure from the furnace chamber 52*a*** is completed.

Clamp Retainer

Figure 9:
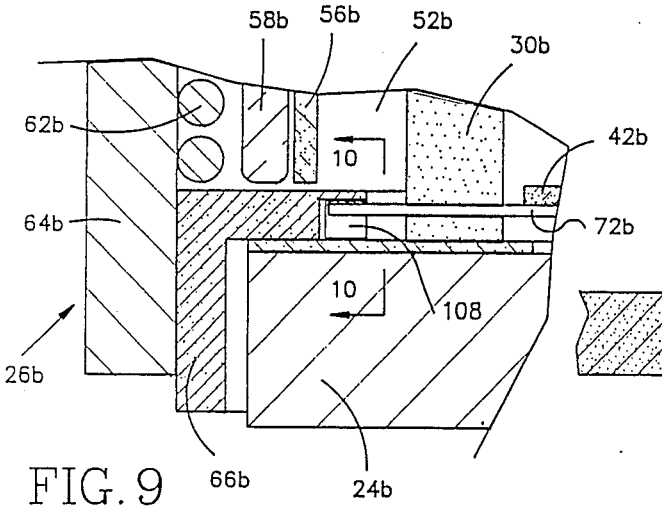
FIG. 9 is a fragmentary sectional view of an embodiment of the invention in which the baffle support elements are engaged by a retainer connected with the furnace.
Figure 10:
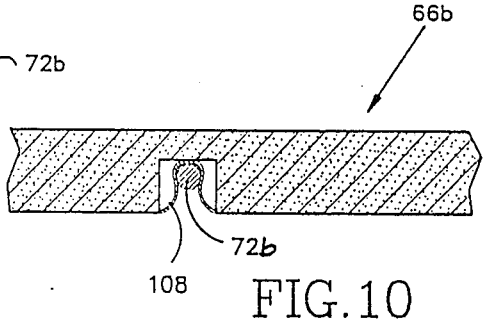
FIG. 10 is a fragmentary sectional view, taken generally along the line 10—10 of FIG. 9, illustrating the manner in which the baffle support element is gripped by the retainer.

In the embodiment of the invention illustrated in FIGS. 1–7, the chill 24 is rotated by the motor 96 to index the support rods 72 relative to the retainer surfaces 84 connected with the furnace 26. It is contemplated that it may be desirable to connect the support rods 72 with the furnace 26 without rotating the chill plate 24. In the embodiment of the invention illustrated in FIGS. 9 and 10, the support elements are moved vertically upwardly into engagement with retainers connected with the furnace and are moved vertically downwardly out of engagement with the retainers. Since the embodiment of the invention illustrated in FIGS. 9 and 10 is generally similar to the embodiment of the invention illustrated in FIGS. 1–7, similar numerals will be utilized to designate similar components, the suffix letter "b" being associated with the numerals of FIGS. 9 and 10 to avoid confusion.

Each support element **72*b* is engaged by a clamp or retainer 108 (FIGS. 9 and 10) connected with the base or Cambridge ring 66*b*. The retainers 108 are stainless steel spring clips which resiliently grip the support elements 72*b*. Although the retainers 108** are spring clips, it is contemplated that other types of retainers, such as mechanical latches or magnets, could be used.

The chill plate **24*b* is raised upwardly with the support elements 72*b* vertically aligned with the retainers 108. The upward force applied against the support elements 72*b* by the chill plate 24*b* moves the support elements into the retainers 108. The inner side surfaces of the retainer 108 firmly grip the support elements to support the chill plate 42*b* during withdrawal of the article molds 30*b* from the furnace chamber 52*b***.

After the article molds **30*b* have been withdrawn from the furnace chamber 52*b*, the gating system (not shown) connected with the upper end portions of the article molds 30*b* applies a downward force against the support elements 72*b* to force them out of the retainers 108. This releases the baffle 42*b* and allows it to drop downwardly onto the chill plate 24*b*. During continued withdrawal of the mold structure from the furnace 26*b*, the baffle 42*b*, support elements 72*b* and mold structure move downwardly together with the chill plate 24*b*. Although only a single support element 72*b* and a single retainer 108 is illustrated in FIGS. 9 and 10**, it should be understood that there are a plurality of support elements and retainers.

Application of Force to Baffle

Figure 11:
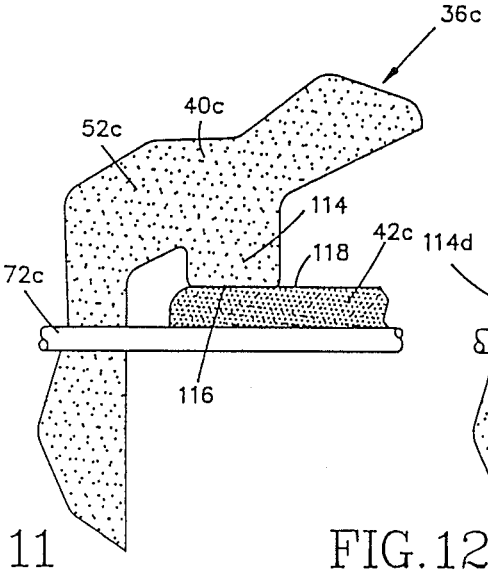
FIG. 11 is a fragmentary sectional view of an embodiment of a mold structure having a surface for applying force against the baffle to either break baffle support elements or release the baffle support elements from retainers connected with the furnace.

In the embodiment of the invention illustrated in FIG. 8, force is applied against the support elements **72*a* to break the support elements. In the embodiment of the invention illustrated in FIGS. 9 and 10, force is applied against the support elements 72*b* to release the support elements from the clamps 108. It is contemplated that it may be desirable to apply the force against the baffle and transmit the force from the baffle to the support elements rather than applying the force directly against the support elements. In the embodiment of the invention illustrated in FIG. 11, force is applied against the baffle. Since the embodiment of the invention illustrated in FIG. 11 is generally similar to the embodiments of the invention illustrated in FIGS. 1–10, similar numerals will be utilized to designate similar components, the suffix letter "c" being associated with FIG. 11** to avoid confusion.

The runner **40*c* of the mold structure is provided with a pressure pad 114 having a flat bottom surface 116 which engages a flat upper surface 118 on the baffle 42*c* to apply pressure against the baffle 42*c*. Although only a single pressure pad 114 has been shown in FIG. 11, it should be understood that there are a plurality of pressure pads on each of the runners 40*c*. These pressure pads are located so as to engage the baffle 42*c* at a plurality of spaced apart locations adjacent to the circular periphery of the baffle. It is contemplated that a single annular pressure pad could be provided to apply force in a continuous circle adjacent to the periphery of the circular baffle 42*c***.

As the withdrawal of the article molds **30*c* from the furnace chamber 52*c* is being completed, the lower surface 116 of the pressure pad 114 moves downwardly into engagement with the stationary upper surface 118 of the baffle 42*c*. Continued withdrawal of the mold structure from the furnace results in the application of force against the baffle 42*c*. This force is transmitted to the support elements 72*c***.

If the support elements **72*c* are formed of a relatively brittle material as are the ceramic support members 72*a* of FIG. 8, the force transmitted from the pressure pad 114 to the support element 72*c* (FIG. 11) through the baffle 42*c* will cause the support element 72*c* to break and release the baffle 42*c* for downward movement onto the chill plate. However, if the support elements 72*c* are formed of a material capable of withstanding substantial bending moments, such as the stainless steel support elements 72*b* of FIGS. 9 and 10, the downward force applied against the baffle 42*c* would result in the support elements 72*c* being released from the retainers 108** or other holding device.

Application of Force to Support Elements

In the embodiment of the invention illustrated in FIG. 11, force is transmitted from the pressure pad 114 connected with the runner **40*c* to the baffle 42*c* and then from the baffle 42*c* to the support element 72*c*. However, it is contemplated that it may be desired to transmit force directly from the mold structure to the support elements. In the embodiment of the invention illustrated in FIG. 12, force is applied directly against the support elements by mold structure at locations adjacent to the upper end portions of the article molds. Since the components of the embodiment of the invention illustrated in FIG. 12 are generally similar to the components of the embodiment of the invention illustrated in FIGS. 1–11, similar numerals will be utilized to designate similar components, the suffix letter "d" being added the numerals of FIG. 12** to avoid confusion.

Figure 12:
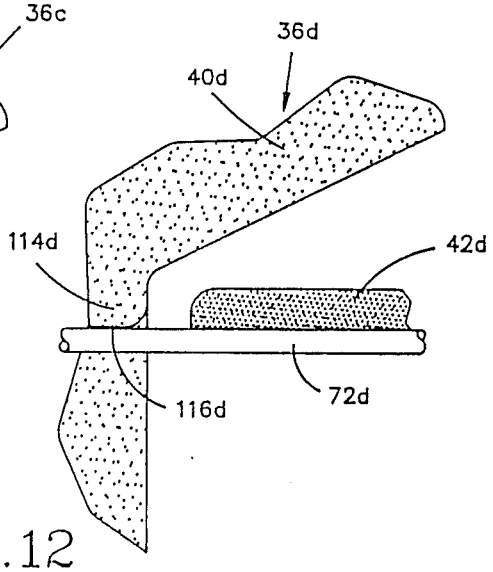
FIG. 12 is a fragmentary sectional view of an embodiment of the mold structure having a surface for applying force against the baffle support elements to either break the baffle support elements or release the baffle support elements from retainers connected with the furnace.

In the embodiment of the invention illustrated in FIG. 12, a pressure pad **114*d* is formed at the connection between the end portion of the article mold 30*d* and the runner 40*d*. The pressure pad 114d has a horizontal downwardly facing surface 116*d* which is engageable with a support element 72*d*** to apply downward force against the support element.

As withdrawal of the article molds **30*d* from the furnace is completed, the surface 116*d* on the pressure pad 114*d* moves into abutting engagement with the support element 72*d*. Continued withdrawal of the mold structure from the furnace results in the application of a downward force directly against the support element 72*d*. If the support element 72*d* is formed of a relatively brittle ceramic material, the downward force would break the support element 72*d* in the manner previously described in conjunction with the embodiment of the invention illustrated in FIG. 8. If the support element 72*d* is formed of a material capable of withstanding the bending moments, downward force applied against the support elements would disengage the support elements from a retainer, corresponding to the retainer 108 of the embodiment of the invention illustrated in FIGS. 9 and 10**.

Conclusion

In view of the foregoing description, it is apparent that the present invention provides a new and improved method and apparatus 20 for use in casting a plurality of articles in a mold structure 22 having an open central portion 34. A baffle 42 is disposed in the open central portion 34 of the array of article molds 30 to retard the transfer of heat from the article molds to a chill plate 24 upon which the article molds are supported. As the article molds are withdrawn from a furnace 26, the baffle 42 is supported by a plurality of support elements 72 which are connected with the furnace and extend through spaces 74 between the article molds 30. After the mold structure 22 has been partially withdrawn from the furnace 26, the support elements 72 are disconnected from the furnace 26 and the baffle 42 drops downwardly onto the chill plate 24 to enable the mold structure to be completely withdrawn from the furnace.

In one embodiment of the invention, the support elements 72 are connected with the furnace 26 by moving the chill plate 24, article molds 30 and the baffle 42 together relative to the furnace to move the support elements into alignment with retainer surfaces 84 connected with the furnace. When the mold structure 22 has been partially withdrawn from the furnace 26, the support elements 72 are separated from the retainer surfaces 84 by reversing the movement of the chill plate 42 and mold structure 22.

In another embodiment of the invention (FIGS. 9 and 10), the support elements **72*b* are moved into engagement with retainers 108 connected with the furnace 72*b* to support the baffle 42*b* from the furnace. After the mold structure 22*b* has been partially withdrawn from the furnace 26*b*, the baffle 42*b* is released by disconnecting the support elements 72*b* from the retainers 108. This may be accomplished by applying force against the baffle 42*b* or support elements 72*b* with surfaces of the mold structure. In still another embodiment of the invention (FIG. 8), the support elements 72*a* are broken to release the baffle 42*a* from the furnace 26*a***.

Having described specific preferred embodiments of the invention, the following is claimed:

1. A method of casting a plurality of articles, said method comprising the steps of supporting a plurality of article molds on a chill plate in an array with an open central portion, moving the article molds at least partially into a furnace chamber while the article molds are supported on the chill plate, conducting a flow of molten metal to the article molds while they are at least partially in the furnace chamber and supported on the chill plate, supporting a baffle with support elements and with the baffle disposed in the central portion of the array of article molds adjacent to lower end portions of the article molds to retard the transfer of heat from upper portions of the article molds of the chill plate, and thereafter, moving the article molds at least part way out of the furnace chamber, and terminating the step of supporting the baffle with support elements after the article molds have been moved at least part way out of the furnace chamber by breaking the support elements.

2. A method as set forth in claim 1 wherein said step of supporting the baffle with support elements includes supporting the baffle from the furnace.

3. A method as set forth in claim 1 wherein said step of supporting the baffle with support elements includes supporting the baffle with support elements which extend between the furnace and baffle through spaces between article molds.

4. A method as set forth in claim 1 further including dropping the baffle downwardly toward the chill plate after having performed said step of breaking the support elements.

5. A method as set forth in claim 4 further including the step of moving the chill plate away from the furnace with the article molds and baffle supported by the chill plate.

6. A method as set forth in claim 1 wherein said step of breaking the support elements includes transmitting downwardly directed force from surfaces of mold structure connected with the article molds to the support elements.

7. A method of casting a plurality of articles, said method comprising the steps of supporting a plurality of article molds on a chill plate in an array with an open central portion, supporting a baffle with the chill plate and with the baffle disposed in the open central portion of the mold structure, moving the article molds at least partially into a furnace chamber while the article molds and baffle are supported by the chill plate, conducting a flow of molten metal to the article molds while they are at least partially in the furnace chamber and supported on the chill plate, supporting the baffle from the furnace with the baffle disposed in the open central portion of the array of article molds and adjacent to lower end portions of the article molds to retard the transfer of heat from upper portions of the article molds to the chill plate, said step of supporting the baffle from the furnace including supporting the baffle with support elements which are disposed above the chill plate and extend between the baffle and furnace by connecting the support elements with the furnace, thereafter, moving the article molds at least part way out of the furnace chamber, and terminating the step of supporting the baffle from the furnace after the article molds have been moved at least part way out of the furnace chamber and with the baffle adjacent to upper end portions of the article molds by disconnecting the support elements from the furnace.

8. A method as set forth in claim 7 wherein said step of connecting the support elements with the furnace includes moving the support elements along a path which extends transverse to a path along which the support elements are moved into the furnace.

9. A method as set forth in claim 7 wherein said step of connecting the support elements with the furnace includes rotating the chill plate, baffle, support elements and article molds together about a central axis of the chill plate.

10. A method as set forth in claim 9 wherein said step of disconnecting the support elements from the furnace includes rotating the chill plate, baffle, support elements and article molds together about the central axis of the chill plate.

11. A method as set forth in claim 7 wherein said step of disconnecting the support elements from the furnace includes breaking the support elements.

12. A method as set forth in claim 7 wherein said step of connecting the support elements with the furnace includes moving the support elements upwardly with the chill plate and into engagement with retainers connected with the furnace.

13. A method as set forth in claim 12 wherein said step of disconnecting the support elements from the furnace includes moving the support elements downwardly and out of engagement with the retainers connected with the furnace.

14. A method as set forth in claim 7 wherein said step of supporting the baffle with support elements includes supporting the baffle with the support elements extending through spaces between the article molds.

15. A method as set forth in claim 7 wherein said step of moving the article molds out of the furnace chamber is at least partially performed with the support elements extending through spaces between the article molds.

16. A method as set forth in claim 7 further including dropping the baffle downwardly toward the chill plate after having performed said step of disconnecting the support elements from the furnace.

17. A method as set forth in claim 7 wherein said step of disconnecting the support elements from the furnace includes transmitting downwardly directed force from surfaces of mold structure connected with the article molds to the support elements.

18. A method of casting a plurality of articles, said method comprising the steps of supporting a plurality of article molds on a chill plate in an array with an open central portion, moving the article molds at least partially into a furnace chamber while the article molds are supported on the chill plate, conducting a flow of molten metal to the article molds while they are at least partially in the furnace chamber and supported on the chill plate, supporting a baffle from the furnace with the baffle disposed in the central portion of the array of article molds adjacent to lower end portions of the article molds to retard the transfer of heat from upper portions of the article molds to the chill plate, said step of supporting the baffle from the furnace including supporting the baffle with support elements which extend between the furnace and baffle through spaces between article molds, thereafter, moving the article molds at least part way out of the furnace chamber, said step of moving the article molds out of the furnace chamber being at least partially performed with the support elements extending through spaces between article molds, and terminating the step of supporting the baffle from the furnace after the article molds have been moved at least part way out of the furnace chamber and with the baffle adjacent to upper end portions of the article molds.

19. A method as set forth in claim 18 wherein said step of terminating the supporting of the baffle from the furnace includes disconnecting the support elements from the furnace.

20. A method as set forth in claim 19 wherein said step of disconnecting the support elements from the furnace includes rotating the chill plate and article molds relative to the furnace.

21. A method as set forth in claim 18 wherein said step of terminating the supporting of the baffle from the furnace includes breaking the supporting elements.

22. A method as set forth in claim 18 wherein said step of terminating the supporting of the baffle from the furnace includes pressing downwardly against the baffle with a gating system connected in fluid communication with the article molds.

23. A method as set forth in claim 18 wherein said step of supporting the baffle from the furnace includes rotating the chill plate, article molds and baffle together relative to the furnace after having at least partially performed said step of moving the article molds into a furnace chamber.

24. A method as set forth in claim 23 wherein said step of terminating the supporting of the baffle from the furnace includes rotating the chill plate, article molds and baffle together relative to the furnace.

25. A method as set forth in claim 18 further including the step of dropping the baffle downwardly toward the chill plate to a position in which the baffle is disposed adjacent to lower end portions of the article molds and is supported by the chill plate after having performed said step of terminating the supporting of the baffle from the furnace.

26. A method as set forth in claim 25 further including the step of moving the chill plate away from the furnace with the article molds and baffle supported by the chill plate.

27. A method as set forth in claim 18 wherein said step of moving the article molds into the furnace chamber includes moving the baffle and support elements into the furnace with the baffle and support elements supported by the chill plate.

28. A method as set forth in claim 27 wherein said step of moving the article molds at least part way out of the furnace chamber includes moving the baffle away from the furnace with the baffle supported by the chill plate.

29. A method as set forth in claim 18 wherein said step of terminating the supporting of the baffle from the furnace includes transmitting downwardly directed force from surfaces of mold structure connected with the article molds to the support elements.

30. A method as set forth in claim 18 wherein said step of supporting the baffle with support elements includes moving the support elements into engagement with retainers connected with the furnace, said step of terminating the supporting of the baffle from the furnace including disengaging the support elements from the retainers under the influence of force transmitted from the article molds.

31. A method as set forth in claim 30 wherein said step of disengaging the support elements from the retainers includes applying downwardly directed force against the baffle with surfaces connected with the article molds.

32. A method as set forth in claim 30 wherein said step of disengaging the support elements from the retainers includes applying downwardly directed forces against the support elements with surfaces connected with the article molds.

33. A method as set forth in claim 30 wherein said step of disengaging the support elements from the retainers includes rotating the support elements and baffle relative to the furnace.

34. A method of casting a plurality of articles, said method comprising the steps of supporting a plurality of article molds on a chill plate in an array with an open central portion, moving the article molds at least partially into a furnace chamber while the article molds are supported on the chill plate, conducting a flow of molten metal to the article molds while they are at least partially in the furnace chamber and supported on the chill plate, supporting a baffle the furnace with the baffle disposed in the central portion of the array of article molds adjacent to lower end portions of the article molds to retard the transfer of heat from upper portions of the article molds to the chill plate, said step of supporting the baffle from the furnace including rotating the chill plate, article molds and baffle together relative to the furnace after having at least partially performed said step of moving the article molds into a furnace chamber, and supporting the baffle with support elements which extend between the furnace and baffle through spaces between article molds, and thereafter, moving the article molds at least part way out of the furnace chamber, said step of moving the article molds out of the furnace chamber being at least partially performed with the support elements extending through spaces between article molds.

35. A method as set forth in claim 34 further including the step of terminating the step of supporting the baffle from the furnace after the article molds have been moved at least part way out of the furnace chamber and with the baffle adjacent to upper end portions of the article molds, by rotating the chill plate, article molds and baffle together relative to the furnace.

36. A method as set forth in claim 34 further including the step of terminating the supporting of the baffle from the furnace by breaking the support elements.

37. A method as set forth in claim 34 further including the steps of disconnecting the support elements from the furnace after having at least partially performed said step of moving the article molds out of the furnace and while the baffle is disposed adjacent to upper end portions of the article molds, and, thereafter, dropping the baffle downwardly toward the chill plate to a position in which the baffle is disposed adjacent to lower end portions of the article molds and is supported by the chill plate.

38. A method as set forth in claim 34 further including the step of moving the chill plate away from the furnace with the article molds and baffle supported by the chill plate.

39. A method as set forth in claim 34 wherein said step of moving the article molds into the furnace chamber includes moving the baffle and support elements into the furnace with the baffle and support elements supported by the chill plate.

40. A method of casting a plurality of articles, said method comprising the steps of supporting a plurality of article molds on a chill plate in an array with an open central portion, moving the article molds at least partially into a furnace chamber while the article molds are supported on the chill plate, conducting a flow of molten metal to the article molds while they are at least partially in the furnace chamber and supported on the chill plate, supporting a baffle from the furnace with the baffle disposed in the central portion of the array of article molds adjacent to lower end portions of the article molds to retard the transfer of heat from upper portions of the article molds to the chill plate, said step of supporting the baffle from the furnace including supporting the baffle with support elements which extend between the furnace and baffle through spaces between article molds, thereafter, moving the article molds at least part way out of the furnace chamber, said step of moving the article molds out of the furnace chamber being at least partially performed with the support elements extending through spaces between article molds, disconnecting the support elements from the furnace after having at least partially performed said step of moving the article molds out of the furnace and while the baffle is disposed adjacent to upper end portions of the article molds, and, thereafter, dropping the baffle downwardly toward the chill plate to a position in which the baffle is disposed adjacent to the lower end portions of the article molds and is supported by the chill plate.

41. A method as set forth in claim 40 wherein said step of disconnecting the support elements from the furnace includes rotating the support elements and baffle together relative to the furnace.

42. A method as set forth in claim 40 wherein said step of disconnecting the support elements from the furnace includes breaking the support elements.

43. A method as set forth in claim 40 wherein said step of disconnecting the support elements from the furnace includes pressing downwardly against the baffle with a gating system connected in fluid communication with the article molds.

44. A method as set forth in claim 40 wherein said step of supporting the baffle from the furnace includes rotating the support elements and baffle together relative to the furnace after having at least partially performed said step of moving the article molds into a furnace chamber.

45. A method as set forth in claim 44 wherein said step of disconnecting the support elements from the furnace includes rotating the support elements and baffle together relative to the furnace.

46. A method as set forth in claim 41 further including the step of moving the chill plate away from the furnace with the article molds and baffle supported by the chill plate.

47. A method as set forth in claim 41 wherein said step of moving the article molds into the furnace chamber includes moving the baffle and support elements into the furnace with the baffle and support elements supported by the chill plate.

48. A method as set forth in claim 41 wherein said step of moving the article molds at least part way out of the furnace chamber includes moving the baffle away from the furnace with the baffle supported by the chill plate.

49. A method as set forth in claim 41 wherein said step of disconnecting the support elements from the furnace includes transmitting downwardly directed force from surfaces connected with the article molds to the support elements.

50. A method as set forth in claim 41 wherein said step of supporting the baffle with support elements includes moving the support elements upwardly into engagement with retainers connected with the furnace, said step of disconnecting the support elements from the furnace includes disengaging the support element under the influence of downwardly directed force transmitted from surfaces connected with the article molds to the support elements.

51. A method as set forth in claim 41 wherein said step of disconnecting the support elements from the furnace includes applying downwardly directed force against the baffle.

52. A method as set forth in claim 41 wherein said step of disconnecting the support elements from the furnace includes applying downwardly directed forces against the support elements with the surfaces connected with the article molds.

53. A method of casting a plurality of articles, said method comprising the steps of supporting a plurality of article molds on a chill plate in an array with an open central portion, moving the article molds at least partially into a furnace chamber while the article molds are supported on the chill plate, conducting a flow of molten metal to the article molds while they are at least partially in the furnace chamber and supported on the chill plate, supporting a baffle from the furnace with the baffle disposed in the central portion of the array of article molds adjacent to lower end portions of the article molds to retard the transfer of heat from upper portions of the article molds to the chill plate, said step of supporting the baffle from the furnace including supporting the baffle with support elements which extend between the furnace and baffle through spaces between article molds, said step of moving the article molds into the furnace include moving the baffle and support elements from a location outside of the furnace chamber into the furnace chamber with the baffle and support elements supported by the chill plate, and thereafter, moving the article molds at least part way out of the furnace chamber, said step of moving the article molds at least part way out of the furnace chamber being at least partially performed with the supported elements extending through spaces between article molds.

54. A method as set forth in claim 53 wherein said step of moving the article molds at least part way out of the furnace chamber includes moving the baffle away from the furnace with the baffle supporting by the chill plate.

55. A method as set forth in claim 53 further including transmitting downwardly directed force from surfaces connected with the article molds to the support elements to terminate the step of supporting the baffle from the furnace.

56. A method as set forth in claim 55 wherein said step of transmitting a downwardly directed force to the support elements includes applying downwardly directed force against the baffle with the surfaces connecting with the article molds.

57. A method as set forth in claim 55 wherein said step of transmitting a downwardly directed force to the support elements includes applying downwardly directed forces against the support elements with the surfaces connected with the article molds.

58. A method as set forth in claim 53 wherein said step of supporting the baffle with support elements includes moving the support elements upwardly into engagement with retainers connected with the furnace, said method further including disengaging the support elements from the retainers under the influence of the downwardly directed force transmitted from surfaces connected with the article molds to the support elements.

59. A method of casting a plurality of articles, said method comprising the steps of supporting a plurality of article molds on a chill plate in an array with an open central portion, moving the article molds at least partially into a furnace chamber while the article molds are supported on the chill plate, conducting a flow of molten metal to the article molds while they are at least partially in the furnace chamber and supported on the chill plate, supporting a baffle from the furnace with the baffle disposed in the central portion of the array of article molds adjacent to lower end portions of the article molds to retard the transfer of heat from upper portions of the article molds to the chill plate, said step of supporting the baffle from the furnace including supporting the baffle with support elements which extend between the furnace and baffle through spaces between article molds, thereafter, moving the article molds at least part way out of the furnace chamber, said step of moving the article molds out of the furnace chamber being at least partially performed with the support elements extending through spaces between article molds, and transmitting downwardly directed force from surfaces of mold structure connected with the article molds to the support elements to terminate the step of supporting the baffle from the furnace.

60. A method as set forth in claim 59 wherein said step of supporting the baffle with support elements includes moving the support elements upwardly into engagement with retainers connected with the furnace, said method further including disengaging the support elements from the retainers under the influence of the downwardly directed force transmitted from the surfaces of mold structure to the support elements.

61. A method as set forth in claim 50 wherein said step of transmitting a downwardly directed force from surfaces of mold structure to the support elements includes applying downwardly directed force against the baffle.

62. A method as set forth in claim 59 wherein said step of transmitting a downwardly directed force from surfaces of mold structure to the support elements includes applying downwardly directed forces against the support elements with the surfaces of the mold structure.

63. A method of casting a plurality of articles, said method comprising the steps of supporting a plurality of article molds on a chill plate in an array with an open central portion, supporting a baffle on the chill plate, moving the baffle and article molds at least partially into a furnace chamber, conducting a flow of molten metal to the article molds while they are at least partially in the furnace chamber and supported on the chill plate, supporting the baffle from the furnace with the baffle disposed in the central portion of the array of article molds adjacent to lower end portions of the article molds to retard the transfer of heat from upper portions of the article molds to the chill plate, said step of supporting the baffle from the furnace including rotating the baffle relative to the furnace chamber after having performed said step of moving the baffle into the furnace chamber, and thereafter, moving the article molds at least part way out of the furnace chamber, said step of moving the article molds out of the furnace chamber being at least partially performed while the baffle is supported from the furnace.

64. A method as set forth in claim 63 further including the step of terminating the step of supporting the baffle from the furnace after the article molds have been moved at least part way out of the furnace chamber and with the baffle adjacent to upper end portions of the article molds.

65. A method as set forth in claim 64 wherein said step of terminating the supporting of the baffle from the furnace includes rotating the baffle relative to the furnace.

66. A method as set forth in claim 64 wherein said step of terminating the supporting of the baffle from the furnace includes pressing downwardly against the baffle with a gating system connected in fluid communication with the article molds.

67. A method as set forth in claim 63 wherein said step of rotating the baffle relative to the furnace chamber includes rotating the chill plate, article molds and baffle together relative to the furnace chamber.

68. A method as set forth in claim 63 further including the step of terminating the step of supporting the baffle from the furnace after having at least partially performed said step of moving the article molds out of the furnace, said step of terminating the supporting of the baffle from the furnace including rotating the chill plate, article molds and baffle together relative to the furnace.

69. A method as set forth in claim 63 further including the steps of terminating the step of supporting the baffle from the furnace after having at least partially performed said step of moving the article molds out of the furnace and while the baffle is disposed adjacent to upper end portions of the article molds, and, thereafter, dropping the baffle downwardly toward the chill plate to a position in which the baffle is disposed adjacent to lower end portions of the article molds and is supported by the chill plate.

70. A method as set forth in claim 69 further including the step of moving the chill plate away from the furnace with the article molds and baffle supported by the chill plate.

71. A method as set forth in claim 63 wherein said step of supporting the baffle from the furnace further includes supporting the baffle with support elements which extend between the furnace and baffle through spaces between article molds.

72. A method as set forth in claim 63 further including transmitting downwardly directed force from surfaces connected with the article molds to the baffle to terminate the step of supporting the baffle from the furnace.

73. A method of casting a plurality of articles, said method comprising the steps of supporting a plurality of article molds in a chill plate in an array with an open central portion, moving a baffle and the article molds at least partially into a furnace chamber while the baffle and article molds are supported by the chill plate, conducting a flow of molten metal to the article molds while they are at least partially in the furnace chamber and supported by the chill plate, supporting the baffle with a plurality of support elements and with the baffle disposed in the central portion of the array of article molds adjacent to lower end portions of the article molds to retard the transfer of heat from upper portions of the article molds to the chill plate, said step of supporting the baffle with a plurality of support elements including gripping the support elements with a plurality of retainers, and thereafter, moving the article molds at least part way out of the furnace chamber, and terminating the step of supporting the baffle with support elements after the article molds have been moved at least part way out of the furnace chamber by disengaging the support elements from the retainers.

74. A method as set forth in claim 73 wherein said step of supporting the baffle with a plurality of support elements includes supporting the baffle with support elements which extend between the furnace and baffle through spaces between article molds.

75. A method as set forth in claim 73 further including dropping the baffle downwardly toward the chill plate after having performed said step of disengaging the support elements from the retainers.

76. A method as set forth in claim 75 further including the step of moving the chill plate away from the furnace with the article molds and baffle supported by the chill plate.

77. A method as set forth in claim 73 wherein said step of disengaging the support elements from the retainers includes transmitting downwardly directed force from surfaces connected with the article molds to the support elements.

78. A method of casting a plurality of articles, said method comprising the steps of supporting a plurality of article molds on a chill plate in an array with an open central portion, moving a baffle and the article molds at least partially into a furnace chamber while the baffle and article molds are supported by the chill plate, conducting a flow of molten metal to the article molds while they are at least partially in the furnace chamber and supported by the chill plate, supporting the baffle with a plurality of support elements and with the baffle disposed in the central portion of the array of article molds adjacent to lower end portions of the article molds to retard the transfer of heat from upper portions of the article molds to the chill plate, said step of supporting the baffle with a plurality of support elements includes supporting the support elements on and blocking downward movement of the support elements with a plurality of retainer surfaces connected with the furnace, and thereafter, moving the article molds at least part way out of the furnace chamber, and terminating the step of supporting the baffle with a plurality of support elements after the article molds have been moved at least part way out of the furnace chamber by disengaging the support elements from the retainer surfaces.

79. A method as set forth in claim 78 wherein said step of supporting the baffle with a plurality of support elements includes supporting the baffle with support elements which extend between the furnace and baffle through spaces between article molds.

80. A method as set forth in claim 78 further including dropping the baffle downwardly toward the chill plate after having performed said step of disengaging the support elements from the retainer surfaces.

81. A method as set forth in claim 80 further including the step of moving the chill plate away from the furnace with the article molds and baffle supported by the chill plate.

82. A method as set forth in claim 81 wherein said step of disengaging the support elements from the retainer surfaces includes transmitting downwardly directed force from surfaces connected with the article molds to the support elements.

83. An apparatus for use in casting a plurality of articles, said apparatus comprising a plurality of article molds disposed in an array with an open central portion, at least some of said article molds being spaced from adjacent article molds, furnace means for transmitting heat to said article molds movable chill plate means for receiving heat during casting of articles in said article molds and for supporting said article molds in said furnace means, baffle means disposed in the open central portion of the array of article molds for retarding the transfer of heat from the array of article molds to said chill plate means, a plurality of support elements extending through spaces between article molds and connecting said furnace means with said baffle means to support said baffle means in the open central portion of the array of article molds, retainer means connected with said furnace means for engaging end portions of said support elements during rotation of said support elements about a central axis of said chill plate means, means for rotating said chill plate means about its central axis to move the end portions of said support elements into engagement with said retainer means, and means for moving said chill plate means and article molds relative to said baffle means and support elements while said baffle means is supported in a stationary relationship with said furnace means by said support elements and while said support elements extend through spaces between article molds to at least partially withdraw said article molds from said furnace means and increase the exposure of said article molds to said chill plate means.

84. An apparatus as set forth in claim 83 wherein said baffle means has a circular configuration, said support elements include a plurality of rods connected with said baffle means and extending radially outwardly from said baffle means and through spaces between article molds.

85. An apparatus as set forth in claim 83 further including surface means connected with said article molds for applying force against said support elements to release said baffle means for movement with said article molds and said chill plate means after said article molds have been at least partially withdrawn from said furnace means.

86. An apparatus for use in casting a plurality of articles, said apparatus comprising a plurality of article molds disposed in an array with an open central portion, at least some of said article molds being spaced from adjacent article molds, furnace means for transmitting heat to said article molds, movable chill plate means for receiving heat during casting of articles in said article molds and for supporting said article molds in said furnace means, baffle means disposed in the open central portion of the array of article molds for retarding the transfer of heat from the array of article molds to said chill plate means, a plurality of support elements extending through spaces between article molds and connecting said furnace means with said baffle means to support said baffle means in the open central portion of the array of article molds, means for moving said chill plate means and article molds relative to said baffle means and support elements while said baffle means is supported in a stationary relationship with said furnace means by said support elements and while said support element extend through spaces between article molds to at least partially withdraw said article molds from said furnace means and increase the exposure of said article molds to said chill plate means, and means for transmitting force to said support elements to break said support elements during withdrawal of the article molds from said furnace means to enable said baffle means to move with said chill plate means.

87. An apparatus as set forth in claim 86 further including retainer means connected with said furnace means for engaging said support elements during rotation of said support elements about a central axis of said chill plate means, and means for rotating said chill plate means about its central axis to move said support elements into engagement with said retainer means.

88. An apparatus as set forth in claim 86 wherein said furnace means includes a susceptor wall at least partially forming a furnace chamber, an induction coil extending around said susceptor wall, and ring means disposed adjacent to lower end portions of said induction coil and said susceptor wall, said ring means at least partially defining an opening to the furnace chamber, said apparatus further including retainer means connected with said ring means for engaging said support elements to at least partially support said baffle means.

89. An apparatus as set forth in claim 88 wherein said retainer means includes surface means for engaging said support elements during relative rotation between said support elements and said ring means about a central axis of said ring means.

90. An apparatus as set forth in claim 86 wherein said baffle means has a circular configuration, said support elements include a plurality of rods connected with said baffle means and extending radially outwardly from said baffle means and through spaces between article molds.

91. An apparatus as set forth in claim 86 wherein said means for transmitting force to said support elements to break said support elements includes surfaces connected with said article molds.

92. An apparatus for use in casting a plurality of articles, said apparatus comprising a plurality of article molds disposed in an array with an open central portion, at least some of said article molds being spaced from adjacent article molds, furnace means for transmitting heat to said article molds, said furnace means includes a susceptor wall at least partially forming a furnace chamber, an induction coil extending around said susceptor wall, and ring means disposed adjacent to lower end portions of said induction coil and said susceptor wall, said ring means at least partially defining an opening to the furnace chamber, movable chill plate means for receiving heat during casting of articles in said article molds and for supporting said article molds in said furnace means, baffle means disposed in the open central portion of the array of article molds for retarding the transfer of heat from the array of article molds to said chill plate means, a plurality of support elements extending through spaces between article molds and connecting said furnace means with said baffle means to support said baffle means in the open central portion of the array of article molds, means for moving said chill plate means and article molds relative to said baffle means and support elements while said baffle means is supported in a stationary relationship with said furnace means by said support elements and while said support elements extend through spaces between article molds to at least partially withdraw said article molds from said furnace means and increase the exposure of said article molds to said chill plate means, and retainer means connected with said ring means for engaging said support elements to at least partially support said baffle means, said retainer means includes surface means for engaging end portions of said support elements during relative rotation between said support elements and said ring means about a central axis of said ring means.

93. An apparatus as set forth in claim 92 wherein said baffle means has a circular configuration, said support elements include a plurality of rods connected with said baffle means and extending radially outwardly from said baffle means and through spaces between article molds.

94. An apparatus as set forth in claim 92 further including surfaces means connected with said article molds for applying force against said support elements to release said baffle means for movement with said article molds and said chill plate means after said article molds have been at least partially withdrawn from said furnace means.

95. An apparatus for use in casting a plurality of articles, said apparatus comprising a plurality of article molds disposed in an array with an open central portion, at least some of said article molds being spaced from adjacent article molds, furnace means for transmitting heat to said article molds, movable chill plate means for receiving heat during casting of articles in said article molds and for supporting said article molds in said furnace means, baffle means disposed in the open central portion of the array of article molds for retarding the transfer of heat from array of article molds to said chill plate means, a plurality of support elements extending through spaces between article molds and connecting said furnace means with said baffle means to support said baffle means in the open central portion of the array of article molds, means for moving said chill plate means and article molds relative to said baffle means and support elements while said baffle means is supported in a stationary relationship with said furnace means by said support elements and while said support elements extend through spaces between article molds to at least partially withdraw said article molds from said furnace means and increase the exposure of said article molds to said chill plate means, surface means connected with said furnace means for engaging said support elements during a portion of the withdrawal of said article molds from said furnace means, and means for rotating said chill plate means and article molds relative to said furnace means to disengage said support elements from said surface means.

96. An apparatus for use in casting a plurality of articles, said apparatus comprising a plurality of article molds disposed in an array with an open central portion, at least some of said article molds being spaced from adjacent article molds, furnace means for transmitting heat to said article molds, movable chill plate means for receiving heat during casting of articles in said article molds and for supporting said article molds in said furnace means, baffle means disposed in the open central portion of the array of article molds for retarding the transfer of heat from the array of article molds to said chill plate means, a plurality of support elements extending through spaces between article molds and connecting said furnace means with said baffle means to support said baffle means in the open central portion of the array of article molds, means for moving said chill plate means and article molds relative to said baffle means and support elements while said baffle means is supported in a stationary relationship with said furnace means by said support elements and while said support elements extend through spaces between article molds to at least partially withdraw said article molds from said furnace means and increase the exposure of said article molds to said chill plate means, and surface means connected with said article molds for applying force against said support elements to release said baffle means for movement with said article molds and said chill plate means after said article molds have been at least partially withdrawn from said furnace means.

97. An apparatus as set forth in claim 96 further including retainer means connected with said furnace means for engaging said support elements during movement of said support elements along a path extending parallel to a central axis of said chill plate means and in a direction toward said furnace means, said surface means being effective to disengage said support elements from said retainer means by applying force against said support elements.

98. An apparatus as set forth in claim 96 wherein said surface means applies force to said support elements to break said support elements during withdrawal of the article molds from said furnace means to release said baffle means for movement with said article molds and said chill plate means.

99. An apparatus as set forth in claim 96 wherein said furnace means includes a susceptor wall at least partially forming a furnace chamber, an induction coil extending around said susceptor wall, and ring means disposed adjacent to lower end portions of said induction coil and said susceptor wall, said ring means at least partially defining an opening to the furnace chamber, said support further including retainer means connected with said ring means for engaging said support elements to at least partially support said baffle means, said surface means being effective to apply force against said support elements to disengage said support elements from said retainer means.

100. An apparatus as set forth in claim 96 wherein said baffle means has a circular configuration, said support elements include a plurality of rods connected with said baffle means and extending radially outwardly from said baffle means and through spaces between article molds.

101. An apparatus as set forth in claim 96 further including retainer means connected with said furnace means for engaging said support elements during a portion of the withdrawal of said article molds from said furnace means, and means for rotating said chill plate means and article molds relative to said furnace means, said surface means being effective to apply force against said support elements to disengage said support elements from said retainer means upon rotation of said chill plate means and article molds.

102. An apparatus as set forth in claim 96 further including retainer means connected with said furnace means for engaging said support elements to retain said baffle means against movement relative to said furnace means prior to the application of force against said support elements by said surface means.

103. An apparatus as set forth in claim 65 wherein said retainer means includes a plurality of spring clips connected with said furnace means, each of said spring clips being engageable with one of said support elements.

104. An apparatus as set forth in claim 96 wherein said support elements extend across the open central portion of the array of article molds.

105. An apparatus for use in casting a plurality of articles, said apparatus comprising a plurality of article molds disposed in an array with an open central portion, at least some of said article molds being spaced from adjacent article molds, furnace means for transmitting heat to said article molds, movable chill plate means for receiving heat during casting of articles in said article molds and for supporting said article molds in said furnace means, baffle means disposed in the open central portion of the array of article molds for retarding the transfer of heat from the array of article molds to said chill plate means, a plurality of support elements extending through spaces between article molds and connecting said furnace means with said baffle means to support said baffle means in the open central portion of the array of article molds, means for moving said chill plate means and article molds relative to said baffle means and support elements while said baffle means is supported in a stationary relationship with said furnace means by said support elements and while said support elements extend through spaces between article molds to at least partially withdraw said article molds from said furnace means and increase the exposure of said article molds to said chill plate means, and surface means connected with said article molds for applying force against said baffle means to release said baffle means for movement with said article molds and said chill plate means after said article molds have been at least partially withdrawn from said furnace means.

106. An apparatus as set forth in claim 105 further including retainer means connected with said furnace means for engaging said support elements to retainer said baffle means against movement relative to said furnace means prior to the application of force against said baffle means by said surface means.

107. An apparatus as set forth in claim 106 wherein said retainer means includes a plurality of spring clips connected with said furnace means, each of said spring clips being engageable with one of said support elements.

108. An apparatus as set forth in claim 105 wherein said support elements extend across the open central portion of the array of article molds.

109. An apparatus as set forth in claim 105 wherein said baffle means has a circular configuration, said support elements include a plurality of rods connected with said baffle means and extending radially outwardly from said baffle means and through spaces between article molds.

110. An apparatus as set forth in claim 105 further including retainer means connected with said furnace means for engaging said support elements during movement of said support elements along a path extending parallel to a central axis of said chill plate means and in a direction toward said furnace means, said surface means being effective to disengage said support elements from said retainer means by applying force against said baffle means.

111. An apparatus as set forth in claim 105 wherein said surface means applies force to said baffle means to break said support elements during withdrawal of the article molds from said furnace means to release said baffle means for movement with said article molds and said chill plate means.

112. An apparatus as set forth in claim 105 wherein said furnace means includes a susceptor wall at least partially forming a furnace chamber, an induction coil extending around said susceptor wall, and ring means disposed adjacent to lower end portions of said induction coil and said susceptor wall, said ring means at least partially defining an opening to the furnace chamber, said apparatus further including retainer means connected with said ring means for engaging said support elements to at least partially support said baffle means, said surface means being effective to apply force against said baffle means to disengage said support elements from said retainer means

* * * * *

UNITED STATES PATENT AND TRADEMARK OFFICE

CERTIFICATE OF CORRECTION

PATENT NO. : 4,774,992

DATED : October 4, 1988

INVENTOR(S) : Thomas George

It is certified that error appears in the above-identified patent and that said Letters Patent is hereby corrected as shown below:

Column 24, line 9, change "claim 65" to -- claim 102 --.

Signed and Sealed this

Fourth Day of July, 1989

*Attest:*

*Attesting Officer*

DONALD J. QUIGG

*Commissioner of Patents and Trademarks*